United States Patent [19]

Partlow

[11] 4,209,168

[45] Jun. 24, 1980

[54] PORTABLE WALL-MOUNTED PHYSICAL CONDITIONING EQUIPMENT KIT

[76] Inventor: Booker T. Partlow, 2101 Madison Ave., Apt. 9D, New York, N.Y. 10037

[21] Appl. No.: 954,144

[22] Filed: Oct. 24, 1978

[51] Int. Cl.[2] ..... A63B 69/22

[52] U.S. Cl. ..... 272/78; 272/144

[58] Field of Search ..... 272/76, 77, 78, 55 R, 272/144, 145

[56] References Cited

U.S. PATENT DOCUMENTS

| | | | |
|---|---|---|---|
| 900,813 | 10/1908 | Wilson | 272/78 |
| 944,648 | 12/1909 | Austin | 272/77 |
| 3,735,979 | 5/1973 | Levenberg | 272/144 |
| 3,874,657 | 4/1975 | Niebojewski | 272/144 |
| 4,136,868 | 1/1979 | Houge | 272/144 |

OTHER PUBLICATIONS

"Black Belt" p. 66, Dec. 1969.
"Black Belt" pp. 52, 53, Mar. 1969.
"Black Belt" p. 57, Nov. 1970.

*Primary Examiner*—Richard C. Pinkham
*Assistant Examiner*—T. Brown
*Attorney, Agent, or Firm*—Jordan and Hamburg

[57] ABSTRACT

A portable wall-mounted physical conditioning equipment kit comprises structure for supporting a foundation board vertically on a wall, a foundation board adapted to be supported by the supporting structure with one face of the foundation board facing the wall and the other face of the foundation board facing away from the wall, respective firmer and softer cushions fastened to respective first and second zones of the other face of the foundation board, the firmer and softer cushions simulating conventional respective heavy and light bags for boxing training, a speed bag, a backboard for the speed bag, the speed bag being suspended from the backboard, an arm at one end mounting the backboard, and a releasable connection engaging the other end of the arm and supporting the arm substantially horizontally extended from the wall.

4 Claims, 10 Drawing Figures

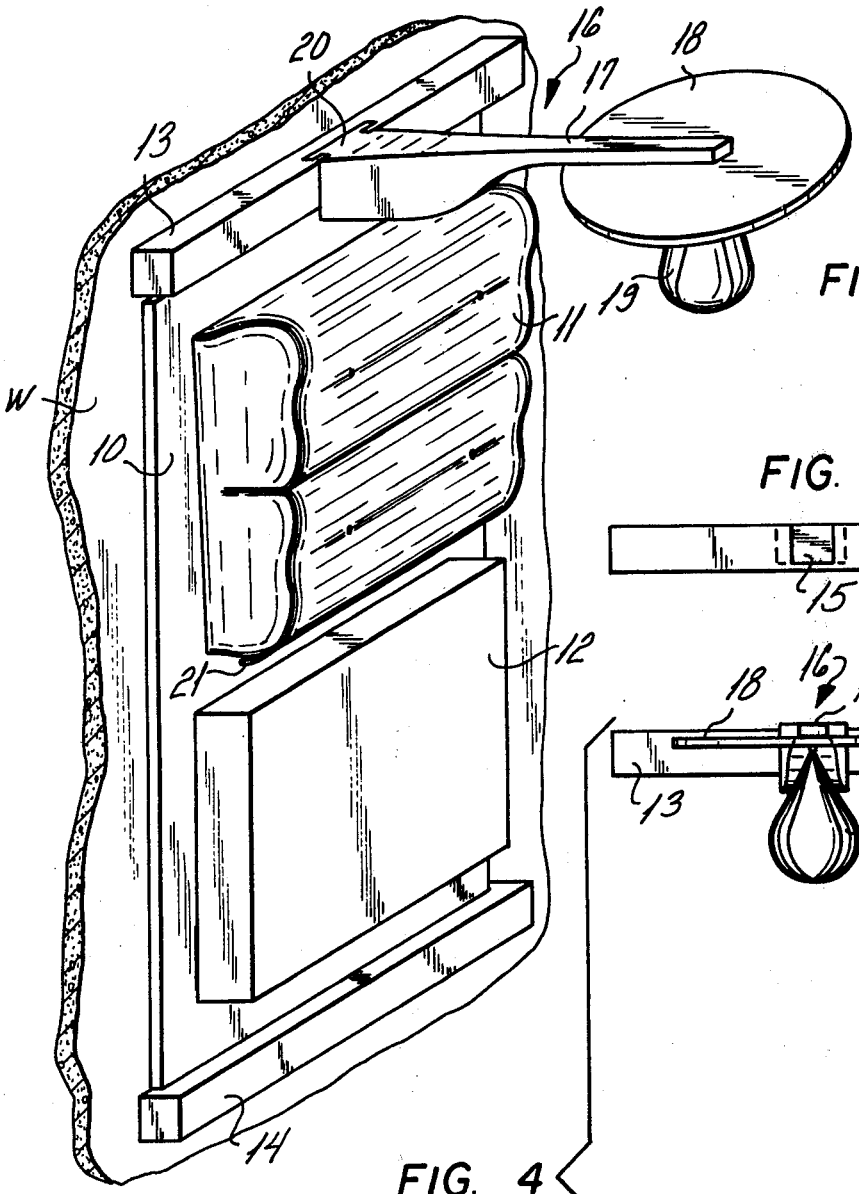
FIG. 1
FIG. 3
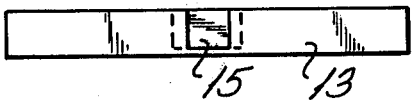
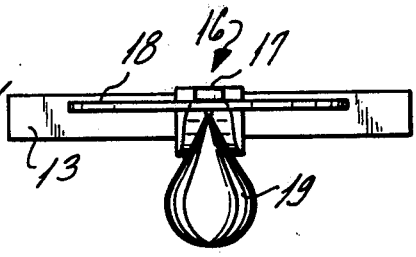
FIG. 4
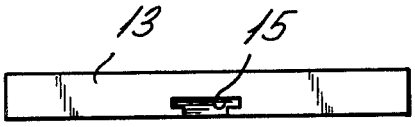
FIG. 2
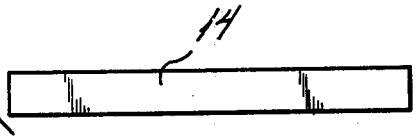

FIG. 5
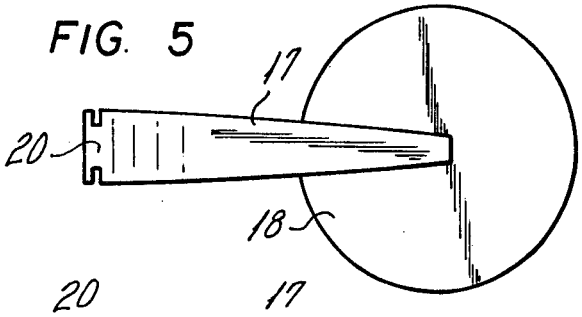
FIG. 6
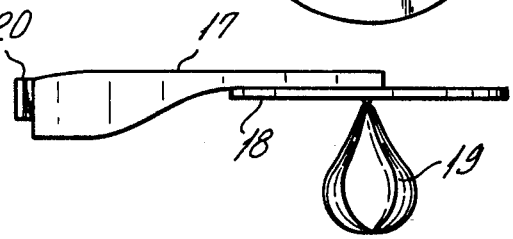
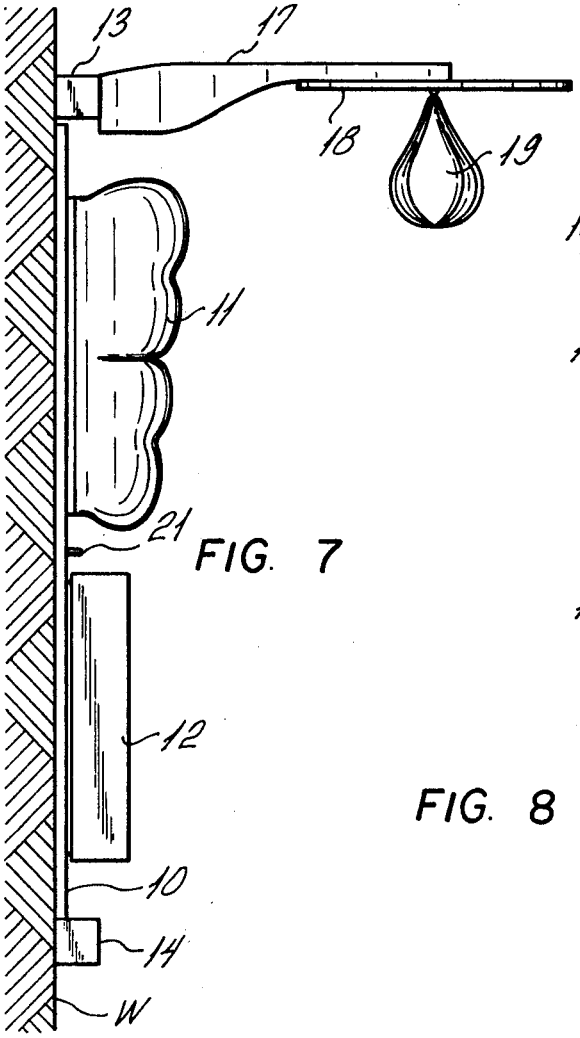
FIG. 7
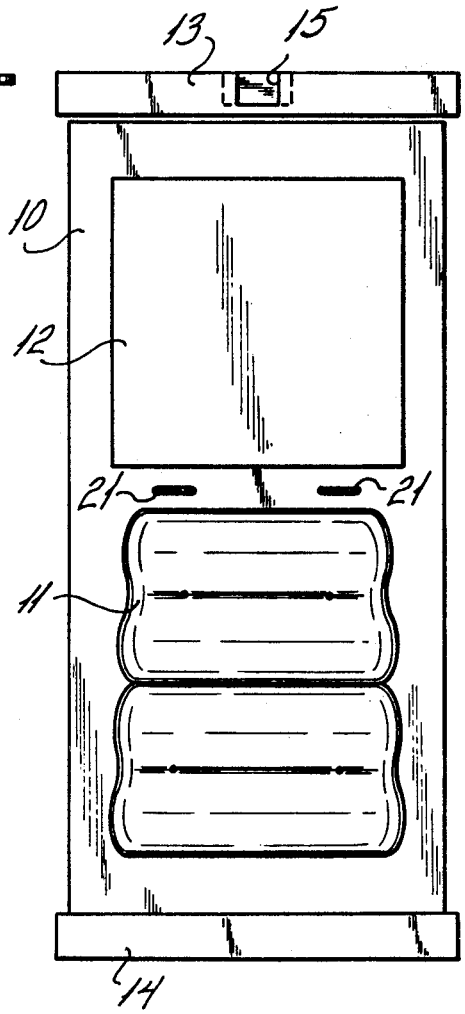
FIG. 8

PORTABLE WALL-MOUNTED PHYSICAL CONDITIONING EQUIPMENT KIT

BACKGROUND OF THE INVENTION

This invention relates to a portable wall-mounted physical conditioning equipment kit.

Aspiring prizefighters and other persons desiring the physical conditioning acquired by boxing training are generally obliged to engage in such training at a gymnasium which has the appropriate equipment. Such equipment usually includes a speed bag, heavy bag and light bag. This equipment, particularly the heavy bag and light bag, apart from being costly, are bulky, heavy and difficult to install in one's home. Moreover, apart from such objects to punch, other physical conditioning is necessary, for example sit ups, for the purpose of increasing the exertion of which a slant board is frequently found in gymnasiums. This is yet another piece of equipment which one normally would find difficult to provide in one's home.

It is, therefore, an object of the present invention to provide a physical conditioning equipment kit which is sufficiently portable and compact to be practical to have in one's home and which provides a speed bag, heavy bag, light bag and, preferably also a slant board for sit ups.

Other objects and advantages of the invention will be apparent from the following description thereof.

SUMMARY OF THE INVENTION

According to the invention, there is provided a portable wall-mounted physical conditioning equipment kit. The kit comprises means for supporting a foundation board vertically on a wall and a foundation board adapted to be supported by the supporting means with one face of the foundation board facing the wall and the other face of the foundation board facing away from the wall. Respective firmer and softer cushion means are fastened to respective first and second zones on the face of the foundation board facing away from the wall. The firmer and softer cushion means simulate conventional respective heavy and light bags for boxing training. The kit also includes a speed bag, a backboard for the speed bag, the speed bag being suspended from the backboard, an arm at one end mounting the backboard, and means for engaging the other end of the arm and supporting the arm substantially horizontally extended from the wall.

The aforementioned support means preferably comprises respective upper and lower members adapted to be mounted on the wall and engage the upper and lower edges of the foundation board. The kit may further comprise an elongated member, one end of the elongated member being adapted to be engaged by the aforementioned upper member, the upper member including means for engaging the aforementioned end of the elongated member, the elongated member being sufficiently long to extend substantially vertically downwardly along the wall when the aforementioned end thereof is engaged by the engaging means. This permits the foundation board to be diagonally propped to provide an inclined support for sit ups with the unencumbered face of the foundation board facing upwardly for supporting a reclining user of the equipment, one end edge of the foundation board engaging the floor and the other end edge of the foundation board engaging the elongated member.

Preferably, the first zone is proximate one end of the foundation board and the second zone is proximate the other end of the foundation board, and the foundation board is supported on the wall with the zone mounting the bag which is desired for use uppermost and at a height convenient for jabbing by a standing user of the equipment. The foundation board is invertable to change bags to be jabbed by a standing user of the equipment.

BRIEF DESCRIPTION OF THE DRAWINGS

FIG. 1 is an isometric view of an entire kit according to the invention, except for the aforementioned elongated member, mounted on a wall;

FIG. 2 is a plan view of the upper supporting means of the kit of FIG. 1;

FIG. 3 is a front elevation of the supporting means of FIG. 2;

FIG. 4 is a front elevation of the kit of FIG. 1 with the foundation board and cushions fastened thereto removed;

FIG. 5 is a plan view of the speed bag attachment of the kit;

FIG. 6 is a side elevation of the speed bag attachment of the kit;

FIG. 7 is a side elevation of the same equipment arranged as in FIG. 1;

FIG. 8 is a front elevation corresponding to FIG. 7 but with the speed bag attachment removed;

DETAILED DESCRIPTION OF A PREFERRED EMBODIMENT

Figure 9:
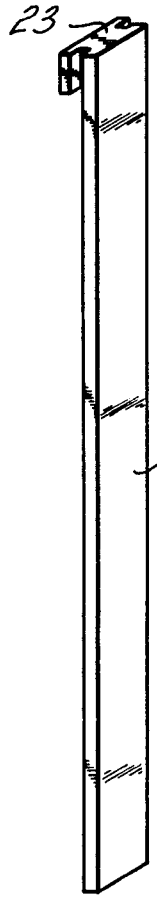
FIG. 9 is an isometric view of the aforementioned elongated member of the kit.

To a foundation board 10, which may, for example, be ¾" plywood, are fastened a firmer cushion 11 and a softer cushion 12. The firmer cushion 11 simulates a conventional suspended heavy bag, and the softer cushion 12 simulates a conventional suspended light bag. Therefore, these cushions will hereinafter be referred to, respectively, as "heavy bag" 11 and "light bag" 12. The foundation board 10 is removably supported on a room wall W by means of upper and lower supporting means 13 and 14. The supporting means 13 and 14 may each be, for example, a 1" by 3" piece of lumber held onto the wall W by suitable fasteners, such as "molly" fasteners (not illustrated). The supporting means 13 and 14 are so spaced that the board 10 is manually insertable therebetween with sufficiently small clearance that the board 10 is not free to tip forward so as to fall from between the supporting means 13 and 14.

The upper supporting means 13 is provided with a T-shaped slot 15 opening at the top of the supporting means 13 and extending not entirely through the thickness thereof (FIGS. 2 and 3). This facilitates mounting of a speed bag attachment 16 according to the invention. The speed bag attachment 16 includes an arm 17 mounting at one end thereof a backboard 18 for a speed bag 19 which is suspended from the center of the backboard 18. The other end of the arm 17 is formed in the shape of a T 20 to be received in the slot 15, whereby the arm 17 is supported extending substantially vertically to and horizontally away from the wall W. It can be appreciated that the speed bag attachment 16 can readily be mounted and demounted. Of course, when the speed bag attachment 16 is being used, the presence of the heavy and light bags 11 and 12 is optional, as illustrated in FIG. 4, since when the speed bag 19 is being used the light and heavy bags 11 and 12 are not being used.

The uppermost of the two bags on the board 10 is at a convenient punching height. If it is desired to use the other bag, the board 10 is simply inverted. For this purpose, it may be particularly convenient to provide a pair of handles 21 between the two bags in order to facilitate removal, inversion and reinsertion of the board 10 between the pair of supporting means 13 and 14. In FIG. 8, the apparatus is illustrated after such inversion has been made in order to place the light bag 12 in punching position.

Figure 10:
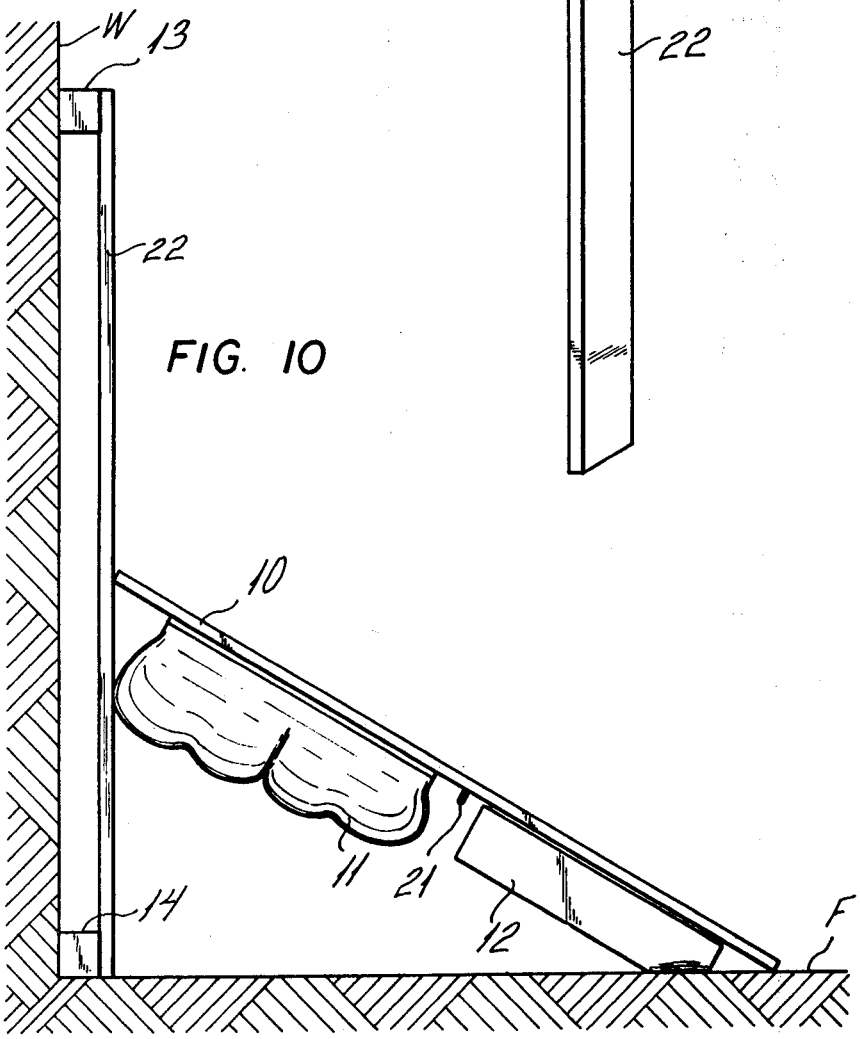
FIG. 10 is a side elevation of portions of the kit showing the elongated member in use.

A further feature of the kit of the present invention involves the provision of an elongated member 22, such as a 1" by 3" board (FIG. 9). At one end of the board 22 is provided a T-shaped member 23 which is sized to be received in the slot 15 of the supporting means 13. The elongated member 22 is illustrated thus mounted in FIG. 10. The lower end of the board 22 is merely supported on the floor F in front of the lower supporting means 14. The board 10 is propped with one end against the member 22 and the other end against the floor F, with the heavy and light bags 11 and 12 facing downwardly and the unobstructed surface of the board facing upwardly. This, thus, constitutes a slant board for sit ups. The person exercising simply reclines on the slant board with his head oriented downwardly and does sit ups with greater exertion than would be required if he were doing sit ups on a level surface.

In the particular embodiment illustrated, the heavy and light bags 11 and 12 extend no more than about eight inches from the wall and the mounted speed bag attachment 16 extends no more than about twenty-five inches from the wall. All of the equipment is readily storable, for example under a bed or in a closet. It will generally be found convenient to leave only the supporting means 13 and 14 on the wall when the equipment is not in use.

The heavy bag 11 is intended for hard punching, improving body punches, upper cuts, right and left crosses, right and left hooks and combinations, the same function as a conventional suspended heavy bag, but requires a small fraction of the space required by a conventional suspended heavy bag. The light bag 12, which is of a squared off shape, provides four corners as targets as well as straight away center as the main target for improving the conventional straight jab. Considering these two "bags" as well as the speed bag and the function of the board 10 alternatively as a slant board for sit ups, it can be seen that the kit of the present invention provides convenient home access to an array of gym equipment vital to boxing training.

What I claim is:

1. A portable wall-mounted physical conditioning equipment kit comprising means for supporting a foundation board vertically on a wall, a foundation board adapted to be removably supported on said wall by said supporting means with one face of the foundation board facing the wall and the other face of the foundation board facing away from the wall, respective firmer and softer cushion means fastened to respective first and second zones on said other face, said firmer and softer cushion means simulating conventional respective heavy and light bags for boxing training, a speed bag, a backboard for the speed bag, the speed bag being suspended from the backboard, an arm having said backboard mounted thereon at one end, and means for releasably attaching the other end of the arm to said supporting means and supporting the arm substantially horizontally extended from the wall.

2. A kit according to claim 1, in which the supporting means comprises respective upper and lower members adapted to be mounted on the wall and engage the upper and lower edges of the foundation board, said arm being attached to said upper member of said supporting means.

3. A kit according to claim 2, further comprising an elongated member, one end of the elongated member being adapted to be releasably engaged by said releasably attaching means of said upper member, said elongated member being sufficiently long to extend substantially vertically downwardly along the wall when said one end thereof is engaged with said attaching means, whereby the foundation board may be diagonally propped to provide an inclined support for sit-ups with said one face of the foundation board facing upwardly for supporting a reclining user of the equipment, one end edge of the foundation board engaging the floor and the other end edge of the foundation board engaging the elongated member.

4. A kit according to claim 3, in which the first zone is proximate one end of the foundation board and the second zone is proximate the other end of the foundation board and the foundation board is removably supported on the wall, such that said cushion means of said first zone can be positioned at a higher elevation than said cushion means of said second zone or said cushion means of said second zone can be positioned at a higher elevation than said cushion means of said first zone and each cushion means can be jabbed at the same elevation by a standing user.

* * * * *